United States Patent [19]

Guzzon

[11] Patent Number: 4,766,272

[45] Date of Patent: Aug. 23, 1988

[54] SEALED PUSH BUTTON SWITCH

[75] Inventor: Giorgio Guzzon, Pero, Italy

[73] Assignee: Officine Meccaniche Vimercati S.p.A., Milan, Italy

[21] Appl. No.: 915,244

[22] Filed: Oct. 2, 1986

[30] Foreign Application Priority Data

Oct. 9, 1985 [IT] Italy ..... 53917/85[U]

[51] Int. Cl.[4] ..... H01H 13/06

[52] U.S. Cl. ..... 200/302.2; 200/340

[58] Field of Search ..... 200/302.2, 340, 338; 400/490, 492, 495, 495.1

[56] References Cited

U.S. PATENT DOCUMENTS

| | | | |
|---|---|---|---|
| 3,821,529 | 6/1974 | Kallage et al. | 200/340 |
| 3,974,351 | 8/1976 | Solov et al. | 200/340 |
| 4,689,454 | 8/1987 | Schulte et al. | 200/340 |

FOREIGN PATENT DOCUMENTS

| | | | |
|---|---|---|---|
| 855676 | 12/1960 | United Kingdom | 200/302.2 |
| 480127 | 8/1975 | U.S.S.R. | 200/340 |

*Primary Examiner*—Renee S. Luebke

*Attorney, Agent, or Firm*—Albert L. Jeffers

[57] ABSTRACT

A sealed push button switch in which the push button is mounted at the end of a movable control member and is connected thereto by means of a self adjusting connector element; the control member is movable against the action of a spring, within a support body, from a first position in which electrical contacts carried by the control member close the circuits connected to the switch itself, to a second position in which these circuits are open; and a resilient sealing bellows extending between the push button and one end of the support body.

3 Claims, 2 Drawing Sheets

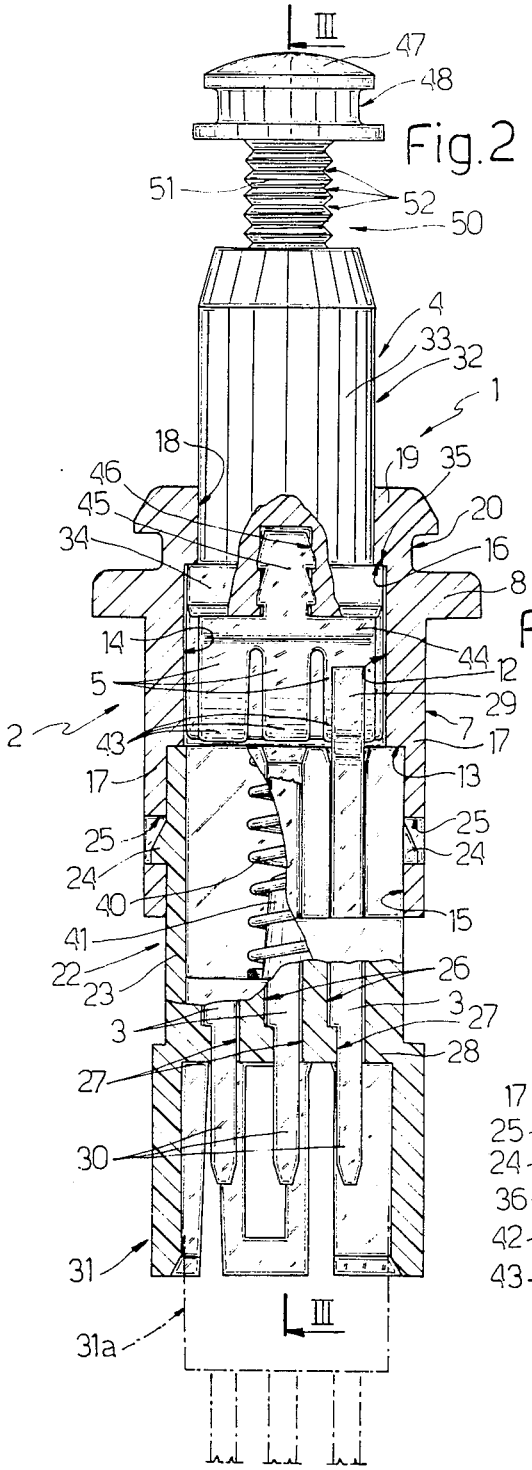
Fig.2
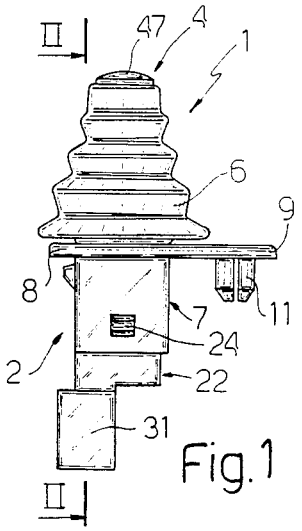
Fig.1
Fig.4
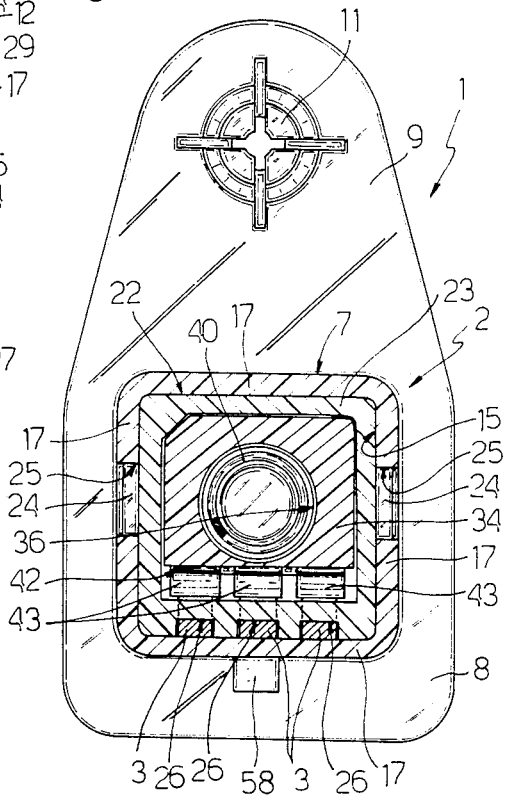

SEALED PUSH BUTTON SWITCH

BACKGROUND OF THE INVENTION

The present invention relates to a sealed push button switch.

In particular, the present invention relates to a switch in which a control rod connected to the push button is constituted by two coaxial portions, a first of which is rigidly connected to the push button and a second of which slidably engages in a support body, being slidable against the action of a spring. The said support body is provided with a plurality of fixed contacts which can be electrically connected to corresponding movable contacts disposed on the second portion of the control rod when this is moved under the thrust of the spring, to an axially extended position with respect to the support body.

The present invention further relates to a switch of the type described above in which the coupling between the control rod and the support body is protected from the infiltration of water or other external agents, and in which the said two portions of the control rod are coupled together by means of a telescopic coupling of adjustable length.

Known push button switches of the type described above are advantageously mounted, above all in motor vehicles, between a fixed member and a movable member to emit signals in dependence on the relative positions of these two members, and are able to compensate for possible assembly tolerances of the members themselves by means of an adjustment of the length of the said control rod.

This adjustment is normally made during assembly of the said two members by moving the movable member to a closure position on the fixed member, in which position the push button of the switch itself is depressed.

From the above it is clear that the said telescopic coupling must have a certain ability to slide in such a way that its length can be automatically adjusted by the movable member when closed onto the fixed member, and must, at the same time, have a certain rigidity in such a way as to retain its proper length once such adjustment has been made.

In known switches of the type described above these two contradictory requirements are not often satisfied, with the consequence that a relatively large number of switches are damaged during the adjustment step.

SUMMARY OF THE INVENTION

The object of the present invention is that of providing a push button switch of the type described above, which will be free from this disadvantage.

A further object of the present invention is that of providing a switch of the type described above, in which the number of component elements is reduced to the minimum, and the connection between the various pieces is as simple as possible for the purpose of limiting the costs of manufacture.

The said objects are achieved by the present invention in that it relates to a sealed push button switch characterised by the fact that it comprises, in combination, a hollow support body, a plurality of electrical contacts mounted in fixed positions within the said support body, a movable control body slidably mounted on the said support body, a resiliently deformable bellows interposed in a fluid tight manner between the said support body and the said movable control member; and a plurality of movable contacts carried by the said movable control member and movable with this latter, with respect to the support body and against the action of resilient means, from an extended position, in which the said movable and fixed contacts are electrically connected together, to a retracted position in which the said movable and fixed contacts are electrically disconnected; the said movable control member including an outer push button, a tubular contact carrier member supporting the said movable contacts, and a connection member rigidly connected to the said push button and telescopically connected to the said contact carrier element; the said connector member having a plurality of seats spaced along its length, and the said contact carrier element including engagement means operable to snap-engage selectively in the said seats whereby to lock the said connector member and contact carrier element axially with respect to one another in any of a plurality of separate relative axial positions.

BRIEF DESCRIPTION OF THE DRAWINGS

The invention will now be described with reference to the attached drawings, which illustrate a non-limitative embodiment thereof, and in which:

FIG. 1 is a side view in elevation of a switch formed according to the principles of the present invention;

FIG. 2 is a section taken on the line II—II of FIG. 1 with parts removed for clarity, FIG. 4 is a section taken on the line IV—IV of FIG. 3.

DETAILED DESCRIPTION OF THE INVENTION

Figure 3:
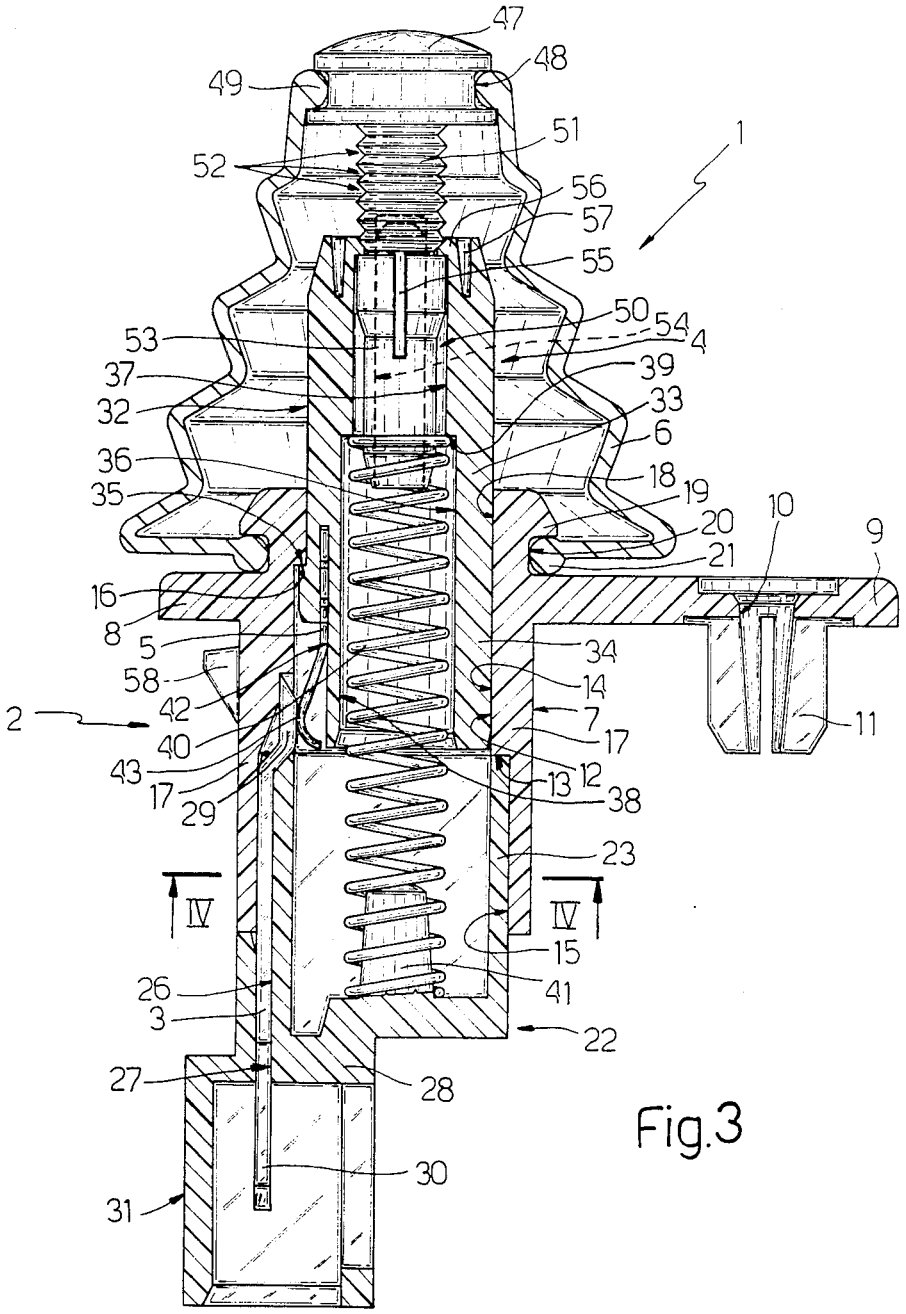
FIG. 3 is a section taken on the line III—III of FIG. 2.

With reference to FIGS. 1 and 2, a push button switch is generally indicated with the reference numeral 1, and comprises a support body 2 which can be connected to a metal sheet (not illustrated) and carries a plurality of fixed contacts 3, a movable member 4 coupled in a slidable manner to the support body 2 and carrying movable contacts 5 connected thereto, and a tubular sealing bellows 6 made of elastomeric material fitted at one end on the movable member 4 and at the other end on the support body 2 to guarantee the impermeability of the coupling between these two elements.

As illustrated, in particular, in FIGS. 2 and 3, the support body 2 includes a front tubular body 7 of substantially square section which has an outer annular flange 8 close to its front end. As illustrated in FIG. 4, the flange 8 is provided laterally with a protuberance 9 through which is formed a hole 10 for the passage of a fixing member (not illustrated) able to connect the switch 1 to the said metal sheet (not illustrated) by elastic deformation of a tubular appendage 11 extending from a rear surface of the protuberance 9 and coaxial with the hole 10.

The tubular body 7 has an axial hole 12 of substantially square section which is provided close to its middle with an annular shoulder 13 joining a front portion 14 of the hole 12, having a narrow section, to a rear portion 15 of the hole 12, having a wider section. The front portion 14 is further provided with another lateral shoulder 16 extending along the inner surface of three of the four lateral walls 17 of the tubular body 7.

The hole 12 terminates at the front with a cylindrical section 18 formed axially along a portion 19 projecting forwardly of the annular flange 8 and having on its outside an annular groove 20 within which a terminal ring 21 of the bellows 16 is engaged in a fluid tight manner.

An open rear end of the tubular body 7 is closed by a fixed contact carrier element 22 in the shape of a cup, the side wall 23 of which is engaged within a rear portion 15 of the hole 12 with its front end in contact with the shoulder 13, and is connected to the body 7 by two projections 24 extending out of the wall 23 and snap-engaged through associated windows 25 formed in the body 7.

On the outer surface of a portion of the lateral wall 23 there are formed axial grooves 26 the rear end of each of which is connected to the front end of an associated axial through hole 27 passing through a rear end wall 28 of the contact carrier element 22. Within each groove 26 there is housed an associated fixed contact 3 a first intermediate section of which is clamped between the wall 23 and the inner surface of one of the walls 17, a second intermediate section of which extends along the associated hole 27, a front section 29 of which projects from the front end of the wall 23 and into the hole 12 and is able to come into contact with an associated movable contact 5, and a rear section 30 of which extends into a plug body 31 integral with the end wall 28 and constitutes a terminal for the connection of the associated contact 3 with a circuit 31*a* to be controlled.

The movable member 4 includes a tubular movable contact carrier element 32 constituted by an externally cylindrical front part 33 slidably mounted in the cylindrical section 18 of the hole 12, and by a rear part 34 of rectangular external form which is slidably mounted within the front portion 14 of the hole 12 and is joined to the front part 33 by means of a shoulder 35 which can cooperate with the inner shoulder 16 of the tubular body 7 to stop the axial outward movement of the movable member 4 with respect to the tubular body 7.

Along the contact carrier element 32 there is formed an axial hole 36 including a front portion 37 of reduced diameter and a rear portion 38 of greater diameter joined to the rear of the front portion 37 by an annular shoulder 39. The shoulder 39 constitutes an abutment for the front end of a spring 40 compressed between the shoulder 39 and the bottom wall 28 and disposed with its rear end fitted on a projection 41 extending from the front surface of the wall 28.

On the outer surface of the rear part 34 of the movable contact carrier element 32 there is formed a rebate 42 within which the movable contacts 5 are located. Each contact 5 is aligned with an associated fixed contact 3 and comprises a rear curved portion 43 which is disposed in contact with the front section 29 of the associated fixed contact 3 when the movable member 4 is positioned, under the thrust of the spring 40, in its extended position with its shoulder 35 in contact with the shoulder 16 (FIG. 3). An axial displacement of the movable member 4 against the thrust of the spring 40, on the other hand, carries each curved portion 43 into contact with the inner surface of the wall 23 and interrupts the electrical contact between the associated movable contact 5 and the corresponding fixed contact 3.

As illustrated in FIG. 2, the movable contacts 5 all extend from the same metal cross-piece 44 lodged within the rebate 42 and provided, on the side opposite the contacts 5, with a toothed appendage 45 engaged under pressure within an associated seat 46 formed axially along the movable contact carrier element 36 and comunicating at the rear with the rebate 42.

The movable member 4 further includes a front control push button 47 provided with an external annular groove 48 in which a front end ring 49 of the bellows 6 is engaged in a fluid-tight manner. The push button 47 is connected to the contact carrier element 32 by means of a connection 50, comprising a front section 51 having a series of outer grooves 52 and rigidly connected at the front to the back of the push button 47, and a rear cylindrical section 53 slidably mounted within the front portion 37 of the hole 36 and provided with an axial hole 54. The hole 54 extends along the whole of the rear section 53 and along part of the front section 51, and communicates laterally with the exterior through axial slots 55 formed on the connection element 50 at the front end of the rear section 53.

The coupling between the connection element 50 and the contact carrier element 32 is a telescopic coupling in which the connection element 50 is fixed axially with respect to the contact carrier element 32 by the snap-engagement of an annular rib 56 extending inwardly of the hole 36 from the front end of the front part 33 of the contact carrier element 32 into one of the grooves 52.

For the purpose of permitting elastic deformation of the rib 56 an axially extending annular notch 57 is formed on the front end of the front part 33 of the contact carrier element 32 entirely around the rib 56.

A projection 58 extending radially outwardly from the tubular body 7 rearwardly of the flange 8 and on the side opposite the protuberance 9 permits the easy connection of the support body 2 to the said metal support sheet not illustrated.

In use, the push button switch 1 is mounted through a hole (not illustrated) in a metal sheet (not illustrated) or other similar fixed suport element, in such a way that its flange 8 and the protuberance 9 rest on the fixed support itself and this latter engages the space lying between the projection 58 and the flange 8.

Before a possible adjustment in length, the connection member 50 is disposed in the position illustrated in FIG. 3 in which the whole of the front section 51 of the connection element 50 projects out from the movable contact carrier element 32.

Upon a first closure, onto the said fixed support element (not illustrated), of a movable element (not illustrated) the position of which is controlled by the switch 1, an adjustment of the length of the connection element 50 normally takes place, the connection element 50 being thrust towards the bottom wall 28 against the action of the spring 40 the thrust of which prevails up to a certain point over the resistance of the rib 56. This latter then disengages from the associated groove 52 to engage a successive groove 52, and in this it is helped both by the transverse elasticity of the connection element 50 due to the presence of the the hole 54 and the slots 55, and by the transverse elasticity of the movable contact carrier element 32 due to the presence of the annular notch 57. From what has been described it will be clearly seen how, whilst engagement between the rib 56 and a groove 52 is in practice stable when the compression force applied to the connection element 50 through the push button 47 does not exceed a pre-determined value, immediate snap-engagement of the rib 56 into a successive groove 52 takes place when the said compression force exceeds the said pre-determined value, which latter depends on the calibration of the spring 40.

I claim:

1. A sealed self compensating push button switch comprising a hollow support body; a plurality of electrical contacts mounted in fixed positions within said support body; a movable control member mounted slidably on said support body; a resiliently deformable bellows interposed between said support body and said movable control member, said bellows engaging said support body and said movable control member in a fluid-tight manner; resilient means interposed between said support body and said movable control member; and a pluraity of movable electrical contacts carried by said movable control member and movable therewith in relation to said support body and against action of said resilient means from a extended position in which said fixed and movable contacts are electrically connected together to a retracted position in which said fixed and movable contacts are electrically disconnected from one another; said movable control member comprising an outer push button, a contact carrier element supporting said movable contacts and having a raidally outwardly elastically deformable portion, and a cylindrical connection member rigidly connected to said push button and telescopically engaging said contact carrier element; said connection member comprising first and second portions, said first poriton being provided with a plurality of outer annular grooves, and said second portion being tubular and extending axially from said first portion, said second section further having axial through slots and being radially inwardly elastically deformable; and rib means extending radially inwardly from said deformable portion of said contact carrier element for selective snap-engagement in said outer grooves thereby to axially lock said connection member and said contact carrier element relative to one another in any one of a plurality of distinct relative axial positions whereby, upon the application of a compression force to said push button in excess of a predetermined value, said rib means engages with a successive one of said outer grooves.

2. A switch as claimed in claim 1 wherein said deformable portion of said contact carrier element is an end portion thereof having an annular end surface facing said button; said end portion carrying said rib means, said rib means being annular and extending about said connection member; said end surface having an annular notch located radially outwardly of said rib means.

3. A switch as claimed in claim 1 wherein said predetermined force in a function of the calibration of said resilient means.

* * * * *